US010360878B2

(12) United States Patent
Yamashita

(10) Patent No.: US 10,360,878 B2
(45) Date of Patent: Jul. 23, 2019

(54) TOPBOARD SUPPORT DEVICE FOR GRAND PIANO

(71) Applicant: KABUSHIKI KAISHA KAWAI GAKKI SEISAKUSHO, Hamamatsu-shi, Shizuoka-ken (JP)

(72) Inventor: Mitsuo Yamashita, Hamamatsu (JP)

(73) Assignee: KABUSHIKI KAISHA KAWAI GAKKI SEISAKUSHO, Hamamatsu-Shi, Shizouka (JP)

( * ) Notice: Subject to any disclaimer, the term of this patent is extended or adjusted under 35 U.S.C. 154(b) by 0 days.

(21) Appl. No.: 15/247,567

(22) Filed: Aug. 25, 2016

(65) Prior Publication Data

US 2017/0061937 A1 Mar. 2, 2017

(30) Foreign Application Priority Data

Sep. 1, 2015 (JP) ..... 171777/2015

(51) Int. Cl.
*G10C 3/02* (2006.01)
*G10C 1/04* (2006.01)

(52) U.S. Cl.
CPC *G10C 3/02* (2013.01); *G10C 1/04* (2013.01)

(58) Field of Classification Search
CPC ..... G10C 3/02; G10C 1/04
USPC ..... 84/177
See application file for complete search history.

(56) References Cited

U.S. PATENT DOCUMENTS 4,657,155 A * 4/1987 Kendrick ..... B65D 43/26 217/60 B
7,101,045 B2 * 9/2006 Romanoff ..... B66F 11/048 248/187.1
7,331,750 B2 * 2/2008 Merz ..... B25J 9/104 414/735
8,063,293 B1 * 11/2011 Kjellgren ..... G10D 13/006 84/422.1
8,442,686 B2 * 5/2013 Saito ..... B25J 9/06 700/245
8,955,846 B2 * 2/2015 Frickey ..... F41J 1/10 248/183.1

(Continued)

FOREIGN PATENT DOCUMENTS

CN 204176270 U * 2/2015
JP 2012-208278 A 10/2012
KR 2007052053 A * 5/2007

*Primary Examiner* — Jianchun Qin
(74) *Attorney, Agent, or Firm* — Lewis Roca Rothgerber Christie, LLP

(57) ABSTRACT

A topboard support device for a grand piano, in which a topboard prop can be accommodated without placing the same on ribs of a frame. The topboard support device supports a topboard capable of opening and closing the top of a piano body, in an open state, and includes the topboard prop for supporting the opened topboard from below by a tip end portion thereof, and a prop support member for supporting the topboard prop via a base end portion thereof in a manner pivotally movable about vertical and horizontal axes. The topboard prop is pivotally moved by the prop support member between a position for being accommodated in a space between the ribs of the frame and an outer rim, in a substantially horizontal posture, and a position for supporting the topboard, in a posture tilted in a manner rising toward a tip end.

6 Claims, 3 Drawing Sheets

(56) References Cited

U.S. PATENT DOCUMENTS

2005/0092891 A1* 5/2005 Shirayanagi ..... F16M 11/10
248/553

* cited by examiner

TOPBOARD SUPPORT DEVICE FOR GRAND PIANO

CROSS-REFERENCE TO RELATED APPLICATION(S)

This application claims priority of Japanese Patent Application Number 171777/2015, filed on Sep. 1, 2015, the entire content of which is incorporated herein by reference.

BACKGROUND OF THE INVENTION

Field of the Invention

The present invention relates to a topboard support device for a grand piano, which is applied to a grand piano, for supporting a topboard, in an open state, which is mounted on the top of a piano body of the grand piano in a manner capable of being opened and closed.

Description of the Related Art

Conventionally, as the topboard support device for a grand piano, of the above-mentioned type, there is known one disclosed e.g. in Japanese Laid-Open Patent Publication (Kokai) No. 2012-208278. This topboard support device supports a topboard which is mounted on the top of a piano body in a manner capable of being opened and closed, using a topboard prop from below, and holds the topboard in an open state. Specifically, the topboard is mounted to a left portion of an outer rim in a manner pivotally movable about a horizontal axis, while the topboard prop is mounted to an inner surface of a right portion of the outer rim in a manner pivotally movable about the horizontal axis.

When the topboard closes the top of the piano body, the topboard is placed on an upper surface of the outer rim, in a horizontal posture. In this case, the topboard prop is accommodated below the topboard in a substantially horizontal posture in a manner crossing ribs each extending in a front-rear direction of a frame within the piano body, in a state partially placed on the ribs. On the other hand, when the topboard is opened, the topboard is pivotally moved upward, and also the topboard prop is also pivotally moved upward, whereafter a tip end portion of the topboard prop is brought into engagement with a receiving portion formed in a lower surface of the topboard. With this, by causing the topboard and the topboard prop to form a substantially right angle therebetween, the opened topboard is held in a stable state.

As described above, when the topboard closes the upper surface of the piano body, the topboard prop is accommodated in the state placed on the ribs of the frame. In this case, the upper surface of the outer rim is required to be set higher in position than the uppermost portion of the topboard prop accommodated in the state placed on the ribs of the frame, so as to avoid interference between the topboard and the topboard prop. For this reason, the dimension of height of the outer rim becomes relatively larger, and as a consequence, the thickness of the piano body is increased. This is against a demand of improving marketability of a grand piano by slimming down a piano body.

SUMMARY OF THE INVENTION

It is an object of the present invention to provide a topboard support device for a grand piano, which is capable of accommodating a topboard prop without placing the same on ribs of a frame, and is thereby capable of making the dimension of height of an outer rim of a piano body smaller than the prior art, thereby enabling the piano body to be slimmed down.

To attain the above object, according to the present invention, there is provided a topboard support device for a grand piano, for supporting a topboard in an open state, the topboard being pivotally mounted to a piano body including a frame having ribs each extending in a front-rear direction and an outer rim disposed in a manner surrounding sides of the frame, thereby being capable of opening and closing a top of the piano body, comprising a topboard prop having a predetermined length and configured to support the topboard having been opened, from below, via a tip end portion thereof, and a prop support member provided inward of the outer rim of the piano body and configured to support the topboard prop via a base end portion thereof in a manner pivotally movable about a vertical axis and a horizontal axis, respectively, wherein the topboard prop is configured to be pivotally moved by the prop support member between an accommodation position where the topboard prop is accommodated in a space between the ribs of the frame and the outer rim, in a substantially horizontal posture, and a topboard support position where the topboard prop supports the topboard, in a posture tilted such that a tip end side thereof rises as the topboard prop extends to the tip end side.

With the construction of this topboard support device for a grand piano, the topboard is pivotally mounted to the piano body of the grand piano, which includes the frame and the outer rim, and is configured to be capable of opening and closing the top of the piano body. On the other hand, the topboard prop is supported, via the base end portion thereof, by the prop support member, in a manner pivotally movable about the vertical axis and the horizontal axis. When the topboard is opened, the topboard in the closed state is pivotally moved upward, and the topboard prop is pivotally moved from the accommodation position toward the topboard support position. Then, the topboard prop is caused to be tilted in a manner rising forward to support the topboard from below via the tip end portion thereof. This causes the opened topboard be supported in a stable state. On the other hand, when the topboard is closed from the open state, the tip end portion of the topboard prop is disengaged from the topboard, and the topboard prop is pivotally moved to the accommodation position, and the topboard is pivotally moved downward.

When the topboard is closed, the topboard prop is accommodated in a substantially horizontal posture in the accommodation position, i.e. in the space between the ribs of the frame and the outer rim. In this accommodation position, the uppermost portion of the topboard prop can be made lower in position than those of the ribs differently from the prior art in which the topboard prop is accommodated in the state placed on the ribs of the frame. Therefore, according to the present invention, the topboard prop can be accommodated without being placed on the ribs of the frame, and it is possible to lower the height of the upper surface of the outer rim, i.e. to reduce the vertical dimension of the outer rim, whereby the piano body can be slimmed down.

Preferably, the frame has a flat part between the ribs and the outer rim, and the prop support member includes a base secured to an upper surface of the flat part of the frame, and a pivotally-movable support part mounted on the base in a manner pivotally movable about the vertical axis and configured to support a base end portion of the topboard prop such that the base end portion can be pivotally moved about the horizontal axis.

With the construction of this preferred embodiment, the prop support member, which includes the base and the pivotally-movable support part, is secured to the upper surface of the flat part of the frame via the base. Further, the pivotally-movable support part is pivotally movable about the vertical axis and supports the base end portion of the topboard prop such that the base end portion can be pivotally moved about the horizontal axis. With the prop support member having such a relatively simple construction as described above, it is possible to pivotally move the topboard prop, with ease, about the vertical axis and the horizontal axis between the accommodation position and the topboard support position. Further, since the base of the prop support member is secured to the frame, it is possible to mount the topboard prop on the piano body in a secure and stable state.

More preferably, the prop support member further includes a locking mechanism configured to lock the pivotally-movable support part, when the topboard prop is in the topboard support position, such that the pivotally-movable support part is pivotally immovable with respect to the base.

With the construction of this preferred embodiment, when the topboard prop is in the topboard support position, the pivotally-movable support part of the prop support member is locked by the locking mechanism such that it is pivotally immovable with respect to the base. With this, in a state in which the topboard is supported by the topboard prop in the topboard support position, the topboard prop can stably support the topboard without the base end portion thereof being pivotally moved about the vertical axis. Further, when the topboard prop is pivotally moved about the vertical axis from the accommodation position toward the topboard support position, the topboard prop is made pivotally immovable when the topboard prop reaches the topboard support position. This makes it possible to easily position the topboard prop in an angular position about the vertical axis, which corresponds to the topboard support position.

Preferably, the prop support member is configured to prevent, when the topboard prop is in the accommodation position, the topboard prop from pivotally moving upward about the horizontal axis.

With the construction of the preferred embodiment, the topboard prop in the accommodation position is prevented by the prop support member from pivotally moving upward about the horizontal axis. This makes it possible to prevent the topboard prop from being accidentally raised from the accommodation position and prevent the topboard from being supported by the topboard prop in an inappropriate position.

The above and other objects, features, and advantages of the present invention will become more apparent from the following detailed description taken in conjunction with the accompanying drawings

DETAILED DESCRIPTION OF PREFERRED EMBODIMENTS

Figure 1A:
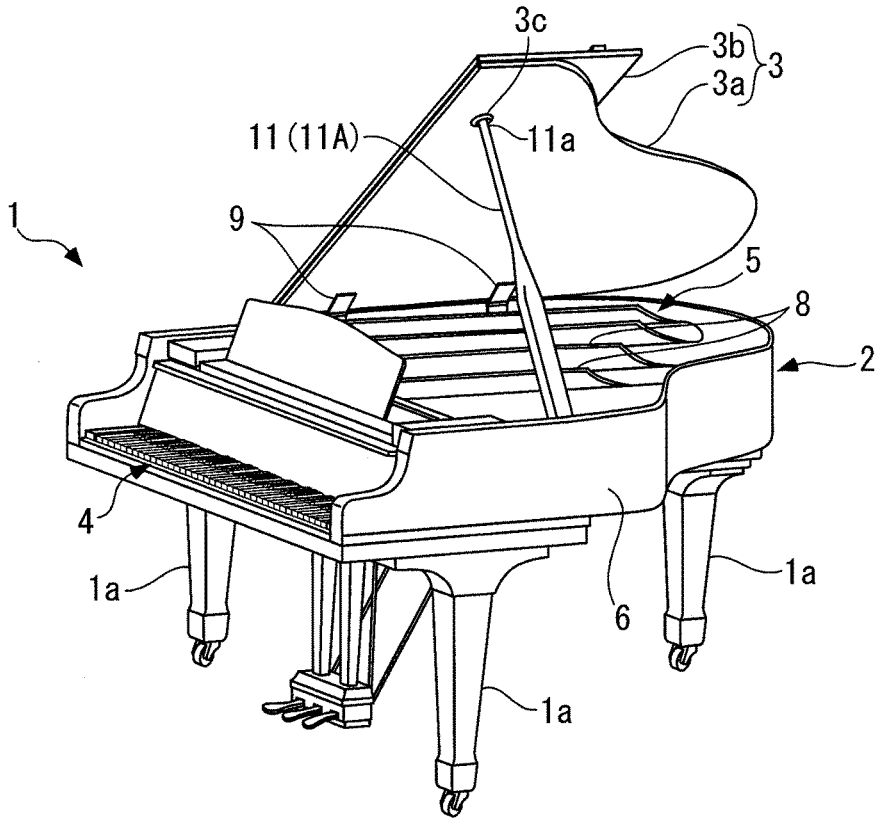
FIG. 1A is a perspective view of a grand piano with a topboard thereof held open.

The present invention will now be described in detail with reference to the drawings showing a preferred embodiment thereof. FIG. 1A shows a grand piano to which is applied a topboard support device according to the embodiment of the present invention. As shown in FIG. 1A, the grand piano 1 includes a piano body 2 supported from below by three legs 1*a*, and a topboard 3 that opens and closes the top of the piano body 2.

In the front part of the piano body 2, there is disposed a keyboard 4 having a large number of white keys and black keys arranged side by side in a left-right direction. On the other hand, in the rear part of the piano body 2, there is disposed a metal frame 5 having a predetermined shape, and an outer rim 6 is disposed in a manner surrounding the sides of the frame 5.

Figure 1B:
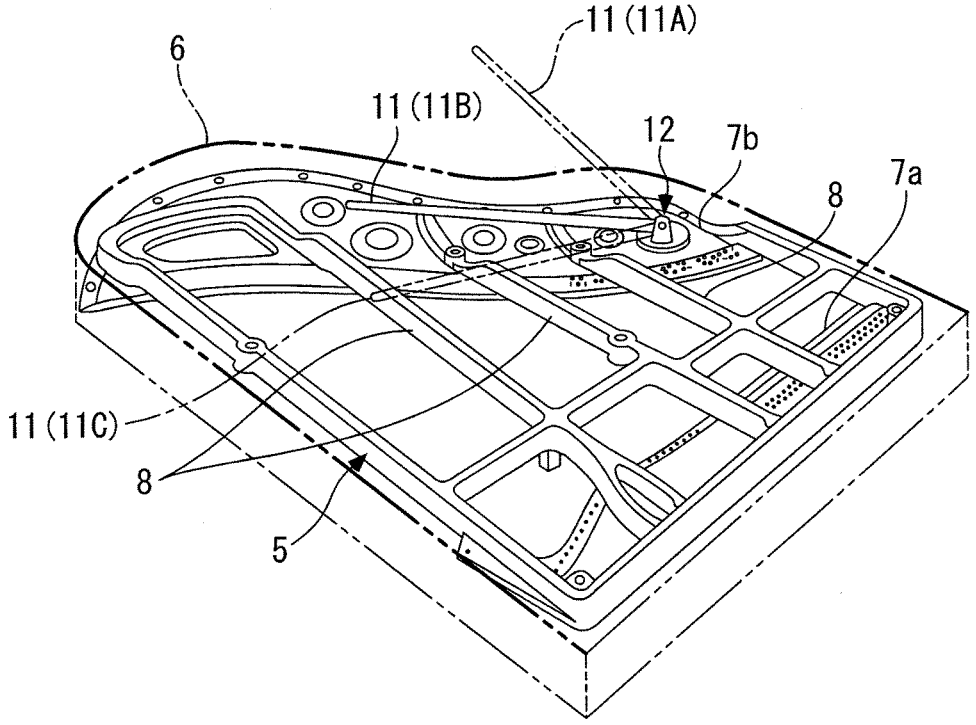
FIG. 1B is a view useful in explaining a positional relationship between an outer rim and a topboard prop, with respect to a frame of the grand piano.
Figure 2:
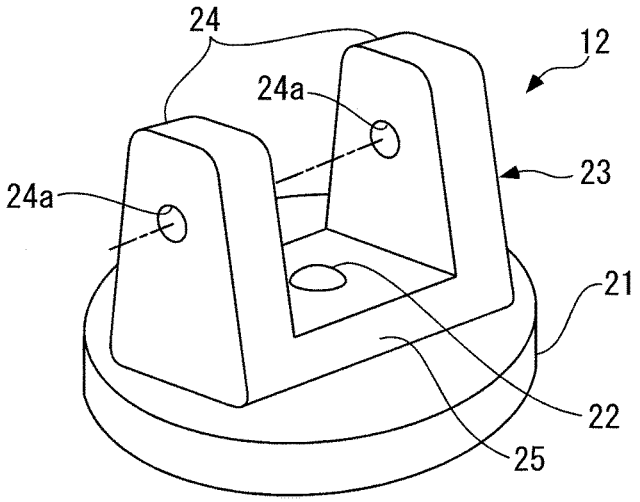
FIG. 2 is a perspective view of a prop support member.

As shown in FIG. 1B, the frame 5 is formed into the predetermined shape by front and rear flat parts 7*a* and 7*b* spaced from each other by a predetermined distance in a front-rear direction, a plurality of ribs 8 each extending in the front-rear direction and connecting between the flat parts 7*a* and 7*b*, and so forth. Note that although not shown, in the frame 5, a large number of strings are stretched between the front and rear flat parts 7*a* and 7*b* in a manner extending in the front-rear direction, and below the frame 5, a large number of actions are arranged side by side in the left-right direction in association with the keys, respectively, each for striking an associated one of the strings in accordance with key depression.

The outer rim 6 is formed of a predetermined material (e.g. wood or a synthetic resin), and is configured to have predetermined thickness and height. As mentioned above, the outer rim 6 is disposed in a manner continuously surrounding the left, right, and rear sides of the frame 5. Further, the height of the outer rim 6 is set such that the upper surface thereof becomes slightly higher than a highest position of the ribs 8. Further, the topboard 3 is mounted to a left portion of the outer rim 6 via front and rear topboard butt hinges 9 and 9 in a manner pivotally movable about a horizontal axis.

The topboard 3 is comprised of a topboard rear 3*a* having approximately the same outside shape as the plan-view shape of the outer rim 6, and a topboard front 3*b* formed into a laterally elongated rectangular shape and foldably connected to the front side of the topboard rear 3*a* by hinges, not shown. In the right front part of the lower surface of the topboard rear 3*a*, there is formed a prop receiving portion 3*c* with which a tip end portion 11*a* of a topboard prop 11 is engaged when the topboard 3 is opened. On the other hand, the topboard prop 11 is formed of a predetermined material (e.g. wood or a synthetic resin) and has a predetermined length. A base end portion 11*b* of the topboard prop 11 is mounted to the frame 5 via a prop support member 12.

FIGS. 2 and 3A to 3C show the prop support member 12. As shown in FIGS. 2 and 3A to 3C, the prop support member 12 is comprised of a base 21 having a circular shape in plan view, and a pivotal support member 23 pivotally connected to the base 21 by a connection bolt 22, for pivotally movably supporting the base end portion 11*b* of the topboard prop 11. The base 21 is formed of a metal plate having a predetermined thickness. The base 21 has a central portion thereof formed with a screw hole 21*a* into which the connection bolt 22 is screwed, and a locking recess 21*b* is formed at a location spaced from the screw hole 21*a* by a predetermined distance.

On the other hand, the pivotal support member 23 is formed of a metal and has a predetermined shape. Specifically, the pivotal support member 23 is formed into a U shape in front view, which opens upward, by two left and right arms 24 and 24 opposed to each other with a predetermined space therebetween and each protruding upward by a predetermined length, and a connection wall 25 connecting between the lower ends of the respective arms 24 and 24.

The arms 24 and 24 have upper portions thereof formed with through holes 24*a*, respectively, and a support shaft 26 horizontally extends through the through holes 24*a* of the respective arms 24 and the base end portion 11*b* of the topboard prop 11 in a state in which the arms 24 and 24 sandwich the base end portion 11*b* of the topboard 11 therebetween. This makes the topboard prop 11 pivotally moveable about the support shaft 26, i.e. about a horizontal axis. On the other hand, the connection wall 25 has a central portion thereof formed with a through hole 25*a* having a slightly larger diameter than that of the connection bolt 22, and the connection bolt 22 is loosely inserted in the through hole 25*a*. This makes the topboard prop 11 pivotally moveable about the connection bolt 22, i.e. about a vertical axis.

Further, in the connection wall 25 of the pivotal support member 23, there is provided a locking mechanism 27 for immovably locking the topboard prop 11 in a predetermined angular position about the vertical axis when the topboard 3 is supported in an open state by the topboard prop 11. The locking mechanism 27 is implemented e.g. by a ball plunger. Specifically, the locking mechanism 27 is comprised of a ball 27*a* having a predetermined diameter and a spring 27*b* for urging the ball 27*a* downward. The ball 27*a* is configured to protrude and retract with respect to the bottom surface of the connection wall 25. When the lower half of the ball 27*a* is fitted in the locking recess 21*b* of the base 21, the pivotal motion of the pivotal support member 23 about the vertical axis is restricted, whereby the topboard prop 11 is locked in the predetermined angular position. Note that the locking mechanism 27 is configured such that when the topboard prop 11 in a locked state is forcibly pivotally moved about the vertical axis by applying an external force larger than a predetermined magnitude thereto, the locking is released.

Figure 3A:
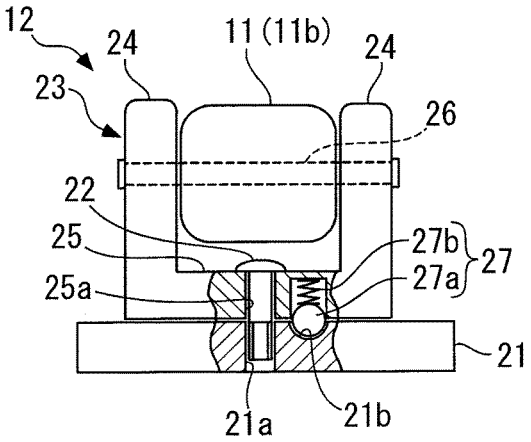
FIG. 3A is a front view of the prop support member shown together with a base end portion of the topboard prop.
Figure 3B:
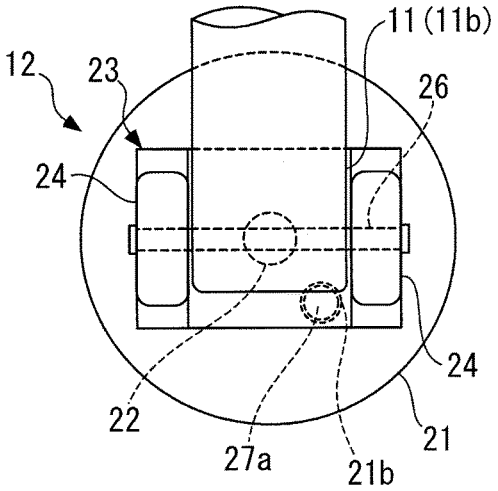
FIG. 3B is a plan view of the prop support member shown together with the base end portion of the topboard prop.
Figure 3C:
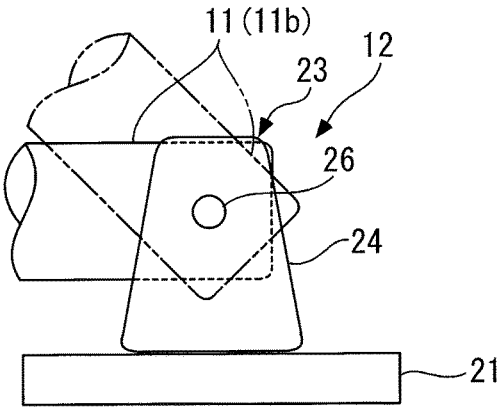
FIG. 3C is a side view of the prop support member shown together with the base end portion of the topboard prop.

Next, a description will be given of how the topboard prop 11 and the prop support member 12 operate when opening and closing the topboard 3. FIG. 1A shows a state in which the topboard 3 in the open state is supported by the topboard prop 11. In this state, the topboard prop 11 (11A) is in a topboard support position in which it is tilted such that a tip end portion 11*a* side rises as it extends toward the tip end portion 11*a* side and that the tip end portion 11*a* and the topboard 3 form a substantially right angle therebetween. Further, in this state, the ball 27*a* of the locking mechanism 27 is engaged with the locking recess 21*b* of the base 21, as shown in FIG. 3A, whereby the topboard prop 11 is locked in a manner immovable about the vertical axis.

Figure 4A:
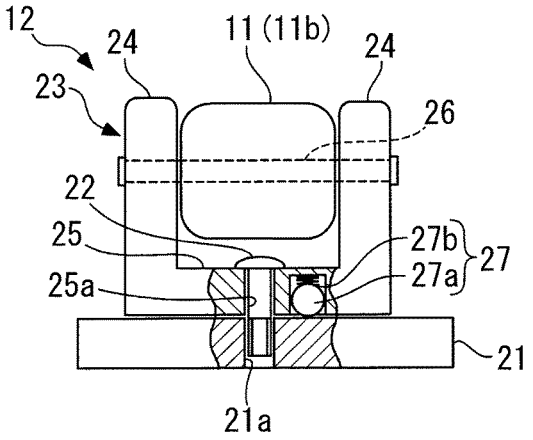
FIG. 4A is a front view of the prop support member with the topboard prop in an accommodation position.
Figure 4B:
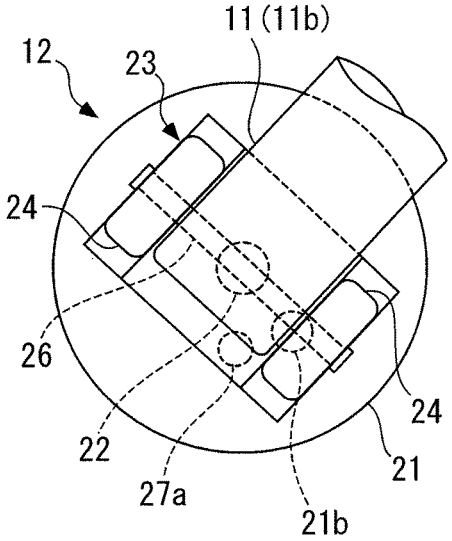
FIG. 4B is a plan view of the prop support member with the topboard prop in the accommodation position.

When the topboard 3 is closed from this state, first, the topboard 3 is pivotally moved slightly upward, whereby the tip end portion 11*a* of the topboard prop 11 is disengaged from the prop receiving portion 3*c* of the topboard 3. Then, the topboard 3 is supported with one hand, and in this state, the topboard prop 11 (11B) is pivotally moved downward and clockwise about the vertical axis, whereby it is brought into a predetermined accommodation position indicated by solid lines in FIG. 1B. Note that in this case, the topboard prop 11 (11A) in the topboard support position is pivotally moved clockwise by an external force larger than the predetermined magnitude, whereby the ball 27*a* of the locking mechanism 27 is disengaged from the locking recess 21*b* of the base 21, as shown in FIGS. 4A and 4B, and is received into the connection wall 25 while pressing the spring 27*b*. As a consequence, the topboard prop 11 is released from the state locked in the manner immovable about the vertical axis.

As shown in FIG. 1B, the topboard prop 11 (11B) in the accommodation position is accommodated in a substantially horizontal posture within a space between the ribs 8 and the outer rim 6 on the rear flat part 7*b*. In the accommodation position, the uppermost portion of the topboard prop 11 (11B) becomes lower than that of each of the ribs 8.

After the topboard prop 11 is pivotally moved to the accommodation position as described above, the topboard 3 is placed on the outer rim 6, whereby the topboard 3 is closed in a horizontal posture. Note that the topboard 3 in the closed state can be opened with ease by following a procedure reverse to the above-described procedure.

As described above, according to the present embodiment, the topboard prop 11 is supported via the base end portion 11*b* by the prop support member 12 in a manner pivotally movable about the vertical axis and the horizontal axis. When the topboard 3 is closed, the topboard prop 11 is accommodated in a substantially horizontal posture in the accommodation position, i.e. in the space between the ribs 8 of the frame 5 and the outer rim 6. In this accommodation position, the uppermost portion of the topboard prop 11 can be made lower in position than those of the ribs 8 differently from the prior art in which the topboard prop is accommodated in a state placed on the ribs 8 of the frame 5 (see the topboard prop 11 (11C) in FIG. 1B). Therefore, it is possible to lower the height of the upper surface of the outer rim 6. i.e. to reduce the dimension of height of the outer rim 6 in the vertical direction, compared with the prior art, to thereby slim down the piano body 2.

Further, when in the topboard support position, the topboard prop 11 is locked by the locking mechanism 27 such that it is pivotally immovable about the vertical axis, and hence it is possible to stably support the topboard 3. Further, when the topboard prop 11 is pivotally moved about the vertical axis from the accommodation position to the topboard support position, the topboard prop 11 becomes pivotally immovable when the topboard prop 11 has reached the topboard support position. This makes it possible to easily position the topboard prop 11 in an angular position about the vertical axis, which corresponds to the topboard support position.

Note that the present invention is not limited to the above-described embodiment, but can be practiced in various forms. For example, in the present embodiment, when the topboard prop 11 is in the topboard support position, the locking mechanism 27 provided in the prop support member 12 locks the topboard prop 11 such that it is pivotally immovable about the vertical axis, but in addition to this, the topboard prop 11 may be also locked in the accommodation position such that it is pivotally immovable. This makes it possible, in the case of closing the topboard 3 in the open state, to easily position the topboard prop 11 in the accommodation position when the topboard prop 11 is pivotally moved from the topboard support position to the accommodation position.

Figure 5A:
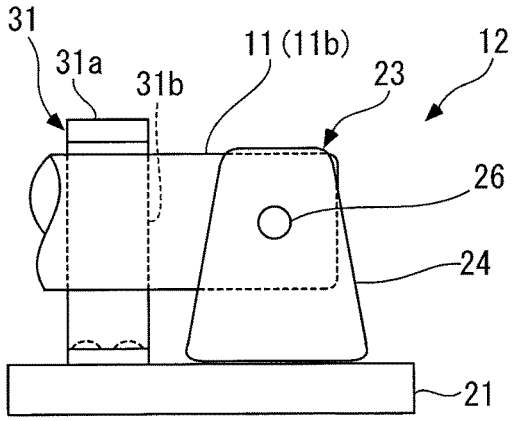
FIG. 5A is a side view of the prop support member having a pivotal motion-preventing member.
Figure 5B:
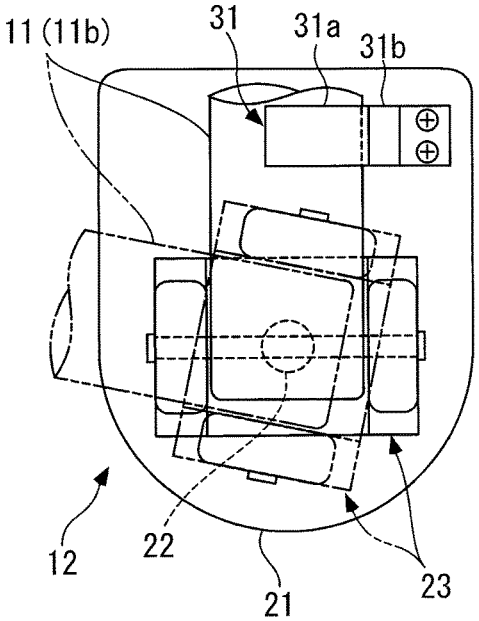
FIG. 5B is a plan view of the prop support member having the pivotal motion-preventing member.

Further, it is preferred that when in the accommodation position, the topboard prop 11 is prevented from pivotally moving upward without any restriction. For example, it is possible to provide the prop support member 12 with a pivotal motion-preventing member 31 appearing in FIGS. 5A and 5B. The pivotal motion-preventing member 31 is formed into a generally L shape by a restriction part 31*a* extending substantially horizontally by a predetermined length and a standing part 31*b* continuous with one end of the restriction part 31*a* and extending vertically by a predetermined length, with a lower end of the standing part 31*b* being secured by screws to the base 21 at a predetermined location. This makes it possible to prevent the topboard prop 11, which is held in a substantially horizontal posture in the accommodation position indicated by solid lines in FIGS. 5A and 5B, from pivotally moving upward about the horizontal axis. Note that when pivotally moved in a counterclockwise direction through a predetermined angle from the accommodation position, the topboard prop 11 becomes capable of being pivotally moved upward about the horizontal axis. By providing the pivotal motion-preventing member 31 as described above, it is possible to prevent the topboard prop 11 from being accidentally raised from the accommodation position to thereby prevent the topboard 3 from being supported by the topboard prop 11 in an inappropriate position. Although in FIGS. 5A and 5B, the pivotal motion-preventing member 31 is mounted on the base 21, it is also possible to mount the same on the frame 5.

Further, although in the present embodiment, the locking mechanism 27 is implemented by the ball plunger by way of example, the locking mechanism 27 is not limited to this, but it is possible to use any of locking mechanisms having various types of construction, so long as it can lock the topboard prop 11 in the topboard support position.

Furthermore, the details of the construction of each of the topboard prop 11 and the prop support member 12 of the present invention are described only by way of example, and it is further understood by those skilled in the art that various changes and modifications may be made thereto without departing from the spirit and scope thereof.

What is claimed is:

1. A topboard support device for a grand piano, for supporting a topboard in an open state, the topboard being pivotally mounted to a piano body including a frame having ribs each extending in a front-rear direction and an outer rim disposed in a manner surrounding sides of the frame, thereby being capable of opening and closing a top of the piano body, comprising:

a topboard prop having a predetermined length and configured to support the topboard having been opened, from below, via a tip end portion thereof; and a prop support member provided inward of the outer rim of the piano body and configured to support said topboard prop via a base end portion thereof in a manner pivotally movable about a vertical axis and a horizontal axis, respectively, wherein said topboard prop is configured to be pivotally moved by said prop support member between an accommodation position where said topboard prop is accommodated in a space between the ribs of the frame and the outer rim in a substantially horizontal posture, and a topboard support position where said topboard prop supports the topboard, in a posture tilted such that a tip end side thereof rises as said topboard prop extends to the tip end side, wherein said prop support member includes: a base secured to an upper surface of the frame, and a pivotal support member pivotally connected to an upper surface of the base by a connection bolt and is capable of rotating in a plane parallel to the upper surface of the base.

2. The topboard support device according to claim 1, wherein the frame has a flat part between the ribs and the outer rim, wherein the base of said prop support member is secured to an upper surface of the flat part of the frame, and wherein said pivotal support member is mounted on said base in a manner pivotally movable about the vertical axis and configured to support a base end portion of said topboard prop such that said base end portion can be pivotally moved about the horizontal axis.

3. The topboard support device according to claim 2, wherein said prop support member further includes a locking mechanism configured to lock said pivotally-movable support part, when said topboard prop is in the topboard support position, such that said pivotally-movable support part is pivotally immovable with respect to said base.

4. The topboard support device according to claim 3, wherein said prop support member is configured to prevent, when said topboard prop is in the accommodation position, said topboard prop from pivotally moving upward about the horizontal axis.

5. The topboard support device according to claim 2, wherein said prop support member is configured to prevent, when said topboard prop is in the accommodation position, said topboard prop from pivotally moving upward about the horizontal axis.

6. The topboard support device according to claim 1, wherein said prop support member is configured to prevent, when said topboard prop is in the accommodation position, said topboard prop from pivotally moving upward about the horizontal axis.

* * * * *